US005334266A

United States Patent [19]

Kawanishi et al.

[11] Patent Number: 5,334,266

[45] Date of Patent: Aug. 2, 1994

[54] HIGH STRENGTH, HEAT RESISTANT ALUMINUM-BASED ALLOYS

[75] Inventors: Makoto Kawanishi; Hidenobu Nagahama, both of Kurobe, Japan

[73] Assignee: Yoshida Kogyo K.K., Tokyo, Japan

[21] Appl. No.: 980,421

[22] Filed: Nov. 23, 1992

Related U.S. Application Data

[63] Continuation of Ser. No. 663,746, Mar. 1, 1991, abandoned.

[30] Foreign Application Priority Data

Mar. 6, 1990 [JP] Japan ..... 2-52635

[51] Int. Cl.[5] ..... C22C 45/08

[52] U.S. Cl. ..... 148/403; 148/415; 148/437; 148/440; 420/550; 420/551

[58] Field of Search ..... 148/304, 415, 416, 417, 148/437, 438, 439, 440, 403; 420/550, 551, 552, 553

[56] References Cited

U.S. PATENT DOCUMENTS

| | | | |
|---|---|---|---|
| 2,865,796 | 12/1958 | Rosenkranz | 148/415 |
| 4,595,429 | 6/1986 | Le Caér et al. | 148/403 |
| 4,715,893 | 12/1987 | Skinner et al. | 148/403 |
| 4,731,133 | 3/1988 | Dermarkar | 148/437 |
| 4,734,130 | 3/1988 | Adam et al. | 148/437 |
| 4,906,531 | 3/1990 | Ohmura et al. | 148/415 |
| 5,171,374 | 12/1992 | Kim et al. | 148/415 |
| 5,223,216 | 6/1993 | LaSalle | 148/439 |
| 5,224,983 | 7/1993 | LaSalle et al. | 148/439 |
| 5,226,983 | 7/1993 | Skinner et al. | 148/437 |

FOREIGN PATENT DOCUMENTS

| | | | |
|---|---|---|---|
| 3524276 | 1/1986 | Fed. Rep. of Germany . | |
| 60-050138 | 3/1985 | Japan | 148/437 |
| 62-47449 | 3/1987 | Japan . | |
| 450424 | 3/1935 | United Kingdom | 420/550 |

OTHER PUBLICATIONS

CA 113(4): 326105 1990.

F. H. Froes, Young-Won Kim and F. Hehmann; "Rapid Solidification of Al, Mg, And Ti" JOM Aug. 1987 pp. 14–21.

*Primary Examiner*—George Wyszomierski

*Attorney, Agent, or Firm*—Flynn, Thiel, Boutell & Tanis

[57] ABSTRACT

High strength, heat resistant aluminum-based alloys have a composition consisting of the following general formula $Al_aM_bX_d$ or $Al_{a'}M_bQ_cX_d$, wherein M is at least one metal element selected from the group consisting of Co, Ni, Cu, Zn and Ag; Q is at least one metal element selected from the group consisting of V, Cr, Mn and Fe; X is at least one metal element selected from the group consisting of Li, Mg, Si, Ca, Ti and Zr; and a, a', b, c and d are, in atomic percentages; $80 \leqq a \leqq 94.5$, $80 \leqq a' \leqq 94$, $5 \leqq b \leqq 15$, $0.5 \leqq c \leqq 3$ and $0.5 \leqq d \leqq 10$. In the above specified alloys, aluminum intermetallic compounds are finely dispersed throughout an aluminum matrix and, thereby, the mechanical properties, especially strength and heat resistance, are considerably improved. The aluminum-based alloys of the present invention are very useful as light-weight, high-strength materials, namely, high specific strength materials, both at room temperature and elevated temperatures.

14 Claims, No Drawings

HIGH STRENGTH, HEAT RESISTANT ALUMINUM-BASED ALLOYS

This application is a continuation of U.S. Ser. No. 07/663,746, filed Mar. 1, 1991, now abandoned.

BACKGROUND OF THE INVENTION

1. Field of the Invention

The present invention relates to aluminum-based alloys having a high strength and a heat-resistance together with a high degree of ductility and formability.

2. Description of the Prior Art

As conventional aluminum-based alloys, there have been known various types of aluminum-based alloys such as Al—Cu, Al—Si, Al—Mg, Al—Cu—Si, Al—Cu—Mg, Al—Zn—Mg alloys, etc. These aluminum-based alloys have been extensively used in a variety of applications, such as structural materials for aircraft, cars, ships or the like; structural materials used in external portions of buildings, sash, roof, etc.; marine apparatus materials and nuclear reactor materials, etc., according to their properties.

In general, the aluminum-based alloys heretofore known have a low hardness and a low heat resistance. In recent years, attempts have been made to achieve a fine structure by rapidly solidifying aluminum-based alloys and thereby improve the mechanical properties, such as strength, and chemical properties, such as corrosion resistance, of the resulting aluminum-based alloys. However, none of the rapid solidified aluminum-based alloys known heretofore has been satisfactory in their properties, especially with regard to strength and heat resistance.

As high strength alloys, Ti alloys are generally known. However, since the known Ti alloys have a small specific strength (ratio of strength to density) because of their large density, there is the problem that they can not be used as materials for applications where light weight and high strength properties are required.

SUMMARY OF THE INVENTION

In view of the foregoing, it is an object of the present invention to provide novel aluminum-based alloys which have a good combination of properties of high strength and high heat resistance together with good ductility and processability making possible processing operations such as extrusion and forging, at a relatively low cost.

A further object of the invention is to provide light-weight, high-strength materials (i.e., high specific strength materials) having the above-mentioned good properties.

According to the present invention, there are provided high strength, heat resistant aluminum-based alloys having a composition consisting of the following general formula (I) or (II).

$$Al_aM_bX_d \quad (I)$$

$$Al_{a'}M_bQ_cX_d \quad (II)$$

wherein:

M is at least one metal element selected from the group consisting of Co, Ni, Cu, Zn and Ag;

Q is at least one metal element selected from the group consisting of V, Cr, Mn and Fe;

X is at least one metal element selected from the group consisting of Li, Mg, Si, Ca, Ti and Zr; and a, a', b, c and d are, in atomic percentages; $80 \leqq a \leqq 94.5$, $80 \leqq a' \leqq 94$, $5 \leqq b \leqq 15$, $0.5 \leqq c \leqq 3$ and $0.5 \leqq d \leqq 10$.

In the above specified alloys, intermetallic compounds, mainly aluminum intermetallic compounds, are finely dispersed in an aluminum matrix.

The aluminum-based alloys of the present invention are very useful as high strength materials and high specific strength materials at room temperature. Further, since the aluminum-based alloys have a high degree of heat resistance, they maintain their high strength levels under service conditions ranging from room temperature to 300° C. and provide good utility for various applications.

DETAILED DESCRIPTION OF THE PREFERRED EMBODIMENTS

The aluminum-based alloys of the present invention can be obtained by rapidly solidifying a melt of the alloy having the composition as specified above employing liquid quenching techniques. The liquid quenching techniques are methods for rapidly cooling a molten alloy and, particularly, the single-roller melt-spinning technique, the twin-roller melt-spinning technique and the in-rotating-water melt-spinning technique are effective. In these techniques, a cooling rate of about $10^4$ to $10^6$ K/sec can be obtained. In order to produce ribbon materials by the single-roller melt-spinning technique or twin-roller melt-spinning technique, the molten alloy is ejected from the bore of a nozzle to a roll of, for example, copper or steel, with a diameter of about 30–300 mm, which is rotating at a constant rate within the range of about 100–4000 rpm. In these techniques, various ribbon materials with a width of about 1–300 mm and a thickness of about 5–1000 pm can be readily obtained. Alternatively, in order to produce wire materials by the in-rotating-water melt-spinning technique, a jet of the molten alloy is directed, under application of a back pressure of argon gas, through a nozzle into a liquid refrigerant layer with a depth of about 1 to 10 cm which is formed by centrifugal force in a drum rotating at a rate of about 50 to 500 rpm. In such a manner, fine wire materials can be readily obtained. In this technique, the angle between the molten alloy ejecting from the nozzle and the liquid refrigerant surface is preferably in the range of about 60° to 90° and the relative velocity ratio of the ejected molten alloy to the liquid refrigerant surface is preferably in the range of about 0.7 to 0.9.

Besides the above process, the alloy of the present invention can be also obtained in the form of a thin film by a sputtering process. Further, rapidly solidified powder of the alloy composition of the present invention can be obtained by various atomizing processes, for example, a high pressure gas atomizing process or a spray process.

In the aluminum-based alloys of the present invention having the composition consisting of the general formula (I), a, b and d are limited to the ranges of 80 to 94.5%, 5 to 15% and 0.5 to 10%, in atomic %, respectively. When "a" is greater than 94.5%, formation of intermetallic compounds having an effect in improving the strength is insufficient. On the other hand, when "a" is smaller than 80%, the hardness becomes larger but the ductility becomes smaller, thereby providing difficulties in extrusion, powder metal forging or other processings. Further, the reason why "b" and "d" are limited to the above ranges is the same as the reason set forth for the limitation of "a".

In the aluminum-based alloys of the present invention represented by the general formula (II), "a'", "b", "c" and "d" are limited to the ranges, in atomic percentages, 80 to 94%, 5 to 15%, 0.5 to 3% and 0.5 to 10%, respectively, for the same reasons as set forth above for the general formula (I).

M element is at least one element selected from the group consisting of Co, Ni, Cu, Zn and Ag and these M elements form thermally stable intermetallic compounds in combination with Al or Al and X element, thereby producing a considerable strengthening effect. The X element is one or more elements selected from the group consisting of Li, Mg, Si, Ca, Ti and Zr. These X elements dissolve in an aluminum matrix to form a solid solution, thereby exhibiting not only a solid solution strengthening effect but also a heat-resistance improving effect in combination with Al and the M elements.

Q element is at least one element selected from the group consisting of V, Cr, Mn and Fe. The Q elements combine with Al and the M elements or Al and the X elements to form intermetallic compounds and thereby providing a further improved heat-resistance as well as stabilization of these elements.

Since the aluminum-based alloys of the present invention represented by the general formula (I) or (II) have a high tensile strength combined with a low density, their specific strength becomes large. Accordingly, the invention aluminum-based alloys are useful as high specific strength materials and are readily processable by extrusion, powder metal forging or the like, at temperatures of 300° to 550° C. Further, the aluminum-based alloys of the present invention exhibit a high strength level in services at a wide temperature range of from room temperature to 300° C.

Now, the present invention will be more specifically described with reference to the following examples.

Examples

Aluminum alloy powder having each of the compositions as given in Table 1 below were prepared using a gas atomizer. The thus obtained aluminum alloy powder was packed into a metal capsule and vacuum hot-pressed into a billet to be extruded while degassing. The billet was extruded at temperatures of 300° to 550° C. by an extruder.

The extruded materials obtained under the above processing conditions have mechanical properties (tensile strength and elongation) at room temperature as shown in the Table 1.

TABLE 1

| No. | Sample | Tensile Strength $\sigma_f$ (MPa) | Elongation E (%) |
|---|---|---|---|
| 1 | $Al_{87}Ni_{10}Ca_3$ | 800 | 3.0 |
| 2 | $Al_{85}Ni_{12}Ti_3$ | 910 | 2.0 |
| 3 | $Al_{85}Ni_{10}Mn_2Zr_3$ | 870 | 2.0 |
| 4 | $Al_{87}Ni_6Zn_4Mg_3$ | 850 | 3.5 |
| 5 | $Al_{88}Ni_8Co_2Zr_2$ | 950 | 2.0 |
| 6 | $Al_{89}Ni_6Zn_3Mg_1Zr_1$ | 840 | 3.5 |
| 7 | $Al_{88}Co_6Zr_6$ | 850 | 1.5 |

It can be seen from the Table 1 that the alloys of the present invention have a very high tensile strength combined with a very high elongation at room temperature.

Further, the samples numbered 1 to 7 were held at a temperature of 150° C. for a period of 100 hours and exhibited the mechanical properties (tensile strength) as shown in Table 2.

TABLE 2

| No. | Sample | Tensile Strength $\sigma_f$ (MPa) |
|---|---|---|
| 1 | $Al_{87}Ni_{10}Ca_3$ | 530 |
| 2 | $Al_{85}Ni_{12}Ti_3$ | 690 |
| 3 | $Al_{85}Ni_{10}Mn_2Zr_3$ | 660 |
| 4 | $Al_{87}Ni_6Zn_4Mg_3$ | 520 |
| 5 | $Al_{88}Ni_8Co_2Zr_2$ | 540 |
| 6 | $Al_{89}Ni_6Zn_3Mg_1Zr_1$ | 620 |
| 7 | $Al_{88}Co_6Zr_6$ | 620 |

It can be seen from the Table 2 that the strength levels of the alloys of the present invention measured at room temperature are not subjected to a significant reduction due to the elevated temperature exposure at 150° C. and the alloys still exhibit high strength levels. Also, the above samples Nos. 1 to 7 exhibit a relatively high strength up to 300° C. For example, the samples numbered 2 and 3 have a tensile strength of about 400 MPa after being exposed at 300° C. for 100 hours and show that they are high strength materials even in such an elevated temperature environment.

Recently, in the aluminum alloys, attempts have been made to obtain strength materials, for example, from conventionally known extra super duralumin through rapid solidification and extrusion. However, the known materials exhibit a tensile strength lower than 800 MPa at room temperature and the tensile strength is drastically reduced after annealing at 150° C. For example, in the material of extra super duralumin, the tensile strength is reduced to 350 MPa.

In comparison with such a drastic strength drop in the conventional materials, the aluminum alloys can have good properties over a wide temperature range of room temperature to elevated temperature environments as high as 300° C.

What is claimed is:

1. A high strength, heat resistant aluminum-based alloy having a composition containing aluminum intermetallic compounds obtained by rapid solidification, said composition consisting of the general formula:

$$Al_aM_bX_d$$

wherein:

M is at least one metal element selected from the group consisting of Ni, Cu, Zn and Ag;

X is at least one metal element selected from the group consisting of Li, Mg, Ca and Zr; and a, b, and d are, in atomic percentages; $80 \leqq a \leqq 94.5$, $5 \leqq b \leqq 15$ and $0.5 \leqq d \leqq 10$.

2. A high strength, heat resistant aluminum-based alloy having a composition containing aluminum intermetallic compounds obtained by rapid solidification, said composition consisting of the general formula:

$$Al_aM_bX_d$$

wherein

M is at least one metal element selected from the group consisting of Ni, Cu, Zn and Ag;

X is at least one metal element selected from the group consisting of Li, Mg, Ca and Ti; and a, b, and d are, in atomic percentages; $80 \leqq a \leqq 94.5$, $5 \leqq b \leqq 15$ and $0.5 \leqq d \leqq 10$.

3. A high strength, heat resistant aluminum-based alloy having a composition containing aluminum intermetallic compounds obtained by rapid solidification, said composition consisting of the general formula:

$$Al_aCo_bX_d$$

wherein:

X is at least one metal element selected from the group consisting of Li, Mg, Ca, Ti and Zr; and a, b, and d are, in atomic percentages; $80 \leqq a \leqq 94.5$, $5 \leqq b \leqq 15$ and $0.5 \leqq d \leqq 10$.

4. A high strength, heat resistant aluminum-based alloy having a composition containing aluminum intermetallic compounds obtained by rapid solidification, said composition consisting of the general formula:

$$Al_{a'}M_bV_cX_d$$

wherein:

M is at least one metal element selected from the group consisting of Ni, Cu, Zn and Ag;

X is at least one metal element selected from the group consisting of Li, Mg, Ca and Zr; and a', b, c and d are, in atomic percentages; $80 \leqq a' \leqq 94$, $5 \leqq b \leqq 15$, $0.5 \leqq c \leqq 3$ and $0.5 \leqq d \leqq 10$.

5. A high strength, heat resistant aluminum-based alloy having a composition containing aluminum intermetallic compounds obtained by rapid solidification, said composition consisting of the general formula:

$$Al_{a'}M_bQ_cX_{d3}Zr_{d4}$$

wherein:

M is at least one metal element selected from the group consisting of Ni, Cu, Zn and Ag;

Q is at least one metal element selected from the group consisting of V, Cr and Mn;

X is at least one metal element selected from the group consisting of Li, Mg and Ca; and a', b, c, d3 and d4 are, in atomic percentages; $80 \leqq a' \leqq 94$, $5 \leqq b \leqq 15$, $0.5 \leqq c \leqq 3$ and $0.5 \leqq d3+d4 \leqq 10$.

6. A high strength, heat resistant aluminum-based alloy having a composition containing aluminum intermetallic compounds obtained by rapid solidification, said composition consisting of the general formula:

$$Al_{a'}M_bQ_cX_d$$

wherein:

M is at least one metal element selected from the group consisting of Co, Ni, Cu, Zn and Ag;

Q is at least one metal element selected from the group consisting of V, Cr and Mn;

X is at least one metal element selected from the group consisting of Li, Mg and Ca and Ti; and a', b, c and d are, in atomic percentages; $80 \leqq a' \leqq 94$, $5 \leqq b \leqq 15$, $0.5 \leqq c \leqq 3$ and $0.5 \leqq d \leqq 10$.

7. A high strength, heat resistant aluminum-based alloy having a composition containing aluminum intermetallic compounds obtained by rapid solidification, said composition consisting of the general formula:

$$Al_{a'}Co_bQ_cX_d$$

wherein:

Q is at least one metal element selected from the group consisting of V, Cr and Mn;

X is at least one metal element selected from the group consisting of Li, Mg, Ca, Ti and Zr; and a', b, c and d are, in atomic percentages; $80 \leqq a'94$, $5 \leqq b \leqq 15$, $0.5 \leqq c \leqq 3$ and $0.5 \leqq d \leqq 10$.

8. A high strength, heat resistant aluminum-based alloy as claimed in claim 1 in which aluminum intermetallic compounds are finely dispersed throughout an aluminum matrix.

9. A high strength, heat resistant aluminum-based alloy as claimed in claim 2 in which aluminum intermetallic compounds are finely dispersed throughout an aluminum matrix.

10. A high strength, heat resistant aluminum-based alloy as claimed in claim 3 in which aluminum intermetallic compounds are finely dispersed throughout an aluminum matrix.

11. A high strength, heat resistant aluminum-based alloy as claimed in claim 4 in which aluminum intermetallic compounds are finely dispersed throughout an aluminum matrix.

12. A high strength, heat resistant aluminum-based alloy as claimed in claim 5 in which aluminum intermetallic compounds are finely dispersed throughout an aluminum matrix.

13. A high strength, heat resistant aluminum-based alloy as claimed in claim 6 in which aluminum intermetallic compounds are finely dispersed throughout an aluminum matrix.

14. A high strength, heat resistant aluminum-based alloy as claimed in claim 7 in which aluminum intermetallic compounds are finely dispersed throughout an aluminum matrix.

* * * * *

UNITED STATES PATENT AND TRADEMARK OFFICE

CERTIFICATE OF CORRECTION

PATENT NO. : 5 334 266

DATED : August 2, 1994

INVENTOR(S) : Makoto KAWANISHI, et al

It is certified that error appears in the above-indentified patent and that said Letters Patent is hereby corrected as shown below:

Column 6, line 21; change "80≦a'94," to ---80≤a'≤94,---.

Signed and Sealed this

Twenty-fifth Day of October, 1994

*Attest:*

Bruce Lehman

BRUCE LEHMAN

*Attesting Officer*

*Commissioner of Patents and Trademarks*